US005971873A

United States Patent [19]

Balducci

[11] Patent Number: 5,971,873

[45] Date of Patent: Oct. 26, 1999

[54] BACKSTOP SCREEN FOR BASKETBALL NET

[76] Inventor: Robert Balducci, 15 Larch Dr., New Hyde Park, N.Y. 11040

[21] Appl. No.: 09/094,273

[22] Filed: Jun. 9, 1998

[51] Int. Cl.[6] ..... A63B 63/08

[52] U.S. Cl. ..... 473/433; 273/396

[58] Field of Search ..... 473/431, 432, 473/433, 434; 273/394, 396, 397

[56] References Cited

U.S. PATENT DOCUMENTS

| | | | |
|---|---|---|---|
| 1,924,757 | 8/1933 | Shisoff | 273/397 |
| 3,362,712 | 1/1968 | Wagner . | |
| 3,901,506 | 8/1975 | Caveney . | |
| 4,206,916 | 6/1980 | Epply . | |
| 4,364,562 | 12/1982 | White et al. . | |
| 4,838,549 | 6/1989 | Woodall | 473/433 |
| 5,133,546 | 7/1992 | Matherne | 273/397 X |
| 5,402,999 | 4/1995 | Keehn, Sr. . | |
| 5,692,976 | 12/1997 | Yu | 473/433 |

*Primary Examiner*—William H. Grieb
*Attorney, Agent, or Firm*—Collard & Roe, P.C.

[57] ABSTRACT

The invention relates to a basketball retrieval device that is connected to a basketball pole. The retrieval device comprises an elongated pole that vertically extends from the basketball pole up to a upper horizontal support arm. The upper support arm supports a screen or net that hangs down behind the backboard. The ball hits the retrieval device and causes the ball to roll back onto the court instead of landing off the court. A lower support arm is attached to the bottom of the basketball pole and secures the bottom of the net in tension.

15 Claims, 4 Drawing Sheets

BACKSTOP SCREEN FOR BASKETBALL NET

BACKGROUND OF THE INVENTION

1. Field of the Invention

The present invention relates to a basketball retrieval device, that is located behind the basketball backboard. The retrieval device catches and returns balls that fall beyond the backboard.

2. The Prior Art

Basketball retrieval devices are widely used to allow basketballs to be returned from behind a backboard. For example, Keehn, Br., U.S. Pat. No. 5,402,999, discloses a basketball safety return apparatus that comprises a net mounted on a set of vertical poles. The net is assembled around a basketball pole to keep the ball from escaping from the property.

Caveney, U.S. Pat. No. 3,901,506, discloses a basketball retrieval apparatus having a pair of side frame deflectors arranged on a backframe. Flexible sheeting extends down from the frame. When a ball is shot, it bounces down through the sheet where it is directed back to a player on the foul line. This allows the shooter to practice free throws without having to expend a lot of energy retrieving the ball.

White et al., U.S. Pat. No. 4,364,562, discloses a basketball rebound target having a target board with netting extending out from the side panels.

Epply, U.S. Pat. No. 4,206,916, discloses a tension net having a frame in which the net is stretched. The net is used as a rebound net for various sports such as tennis and baseball.

Wagner, U.S. Pat. No. 3,362,712, discloses a basketball game having side panels and a ramp for returning the ball within the confines of the game area.

While the prior art does show a wide array of basketball retrieval systems, the prior art does not show a basketball retrieval system located behind a basketball backboard that is attached to the basketball pole.

SUMMARY OF THE INVENTION

The present invention comprises a basketball retrieval system which has a support member that is connected to a basketball pole, and a screen connected to the support member. The screen hangs down behind the backboard and catches and retrieves basketballs. At the bottom of the screen is a weight for holding the screen in tension. The weight can be a bar which extends across the width of the screen and connects to the back of the bottom of the basketball pole. The support member can be elevated by an elongated pole that extends upwardly from the basketball pole. For example, the bottom end of the extending pole connects to the basketball pole, and the top end of the extending pole connects to the support member. The extending pole in combination with the basketball pole and the support member raises the height of the retrieval system to at least thirteen feet. In addition, the support member can be up to nine feet long, and is preferably in the form of a 1½ inch diameter galvanized pipe, while the bottom weight can also be at least nine feet long, and also a 1½ inch galvanized pipe. Finally, the extending pole can also be a 1½ inch galvanized pipe.

Therefore, according to the present invention, a user can set up a basketball retrieval system using a minimal amount of material, wherein only a support member, a bottom weight, and a screen are necessary. The weight and the bottom of the net connect to the base of the basketball pole, such that when a basketball player misses the back of the basketball backboard, the ball hits the net and then rolls back on to the court.

It is therefore an object of the present invention to provide a basketball retrieving system that consists up to four pieces of equipment and is easy to install. It is a further object of the invention to provide a basketball retrieval system that operates efficiently and reliably.

Still another object of the invention is to create a basketball retrieval system that is easy to produce and inexpensive to manufacture.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
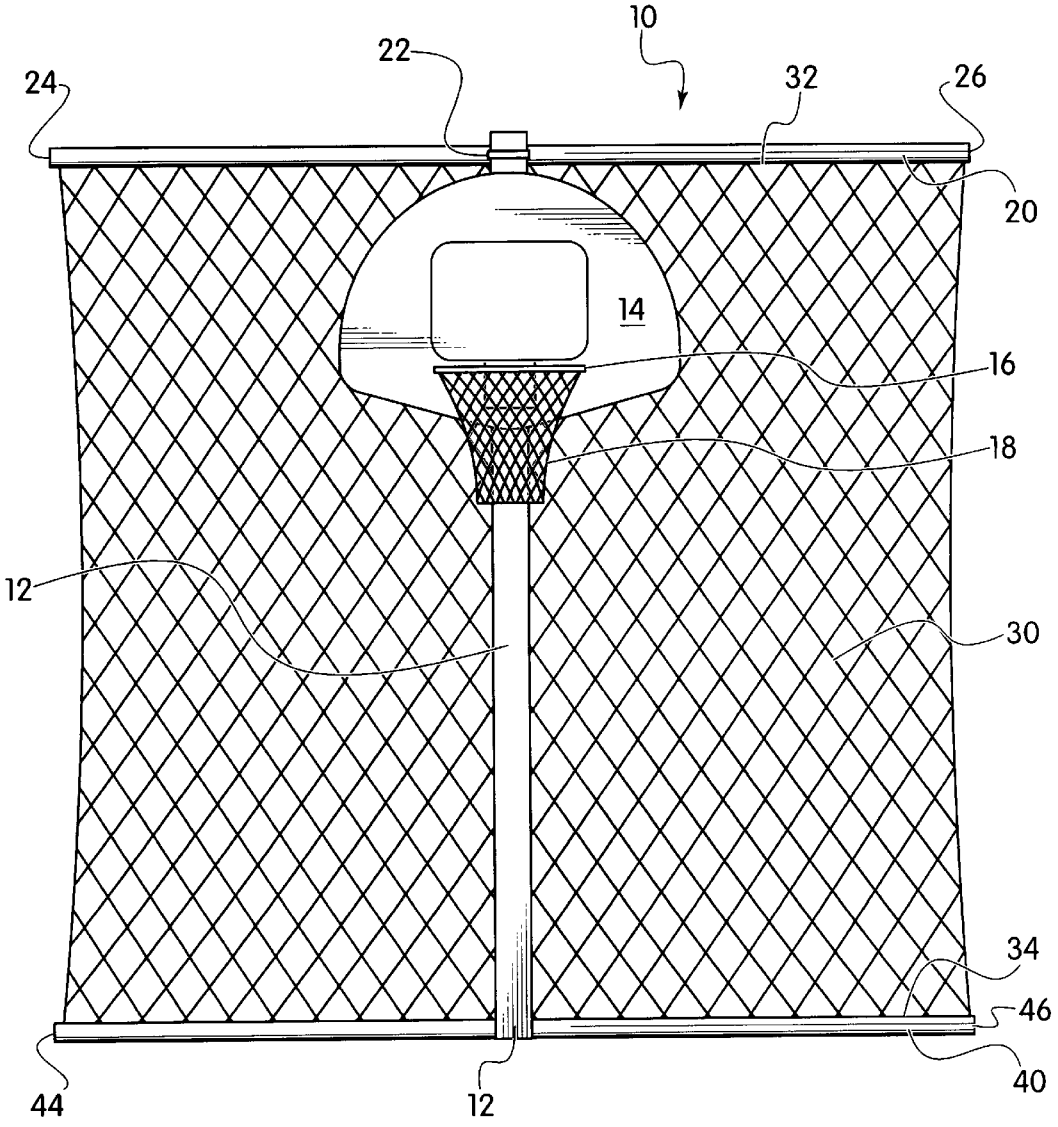
FIG. 1 is a front view of a basketball backboard with a basketball retrieval system.
Figure 2:
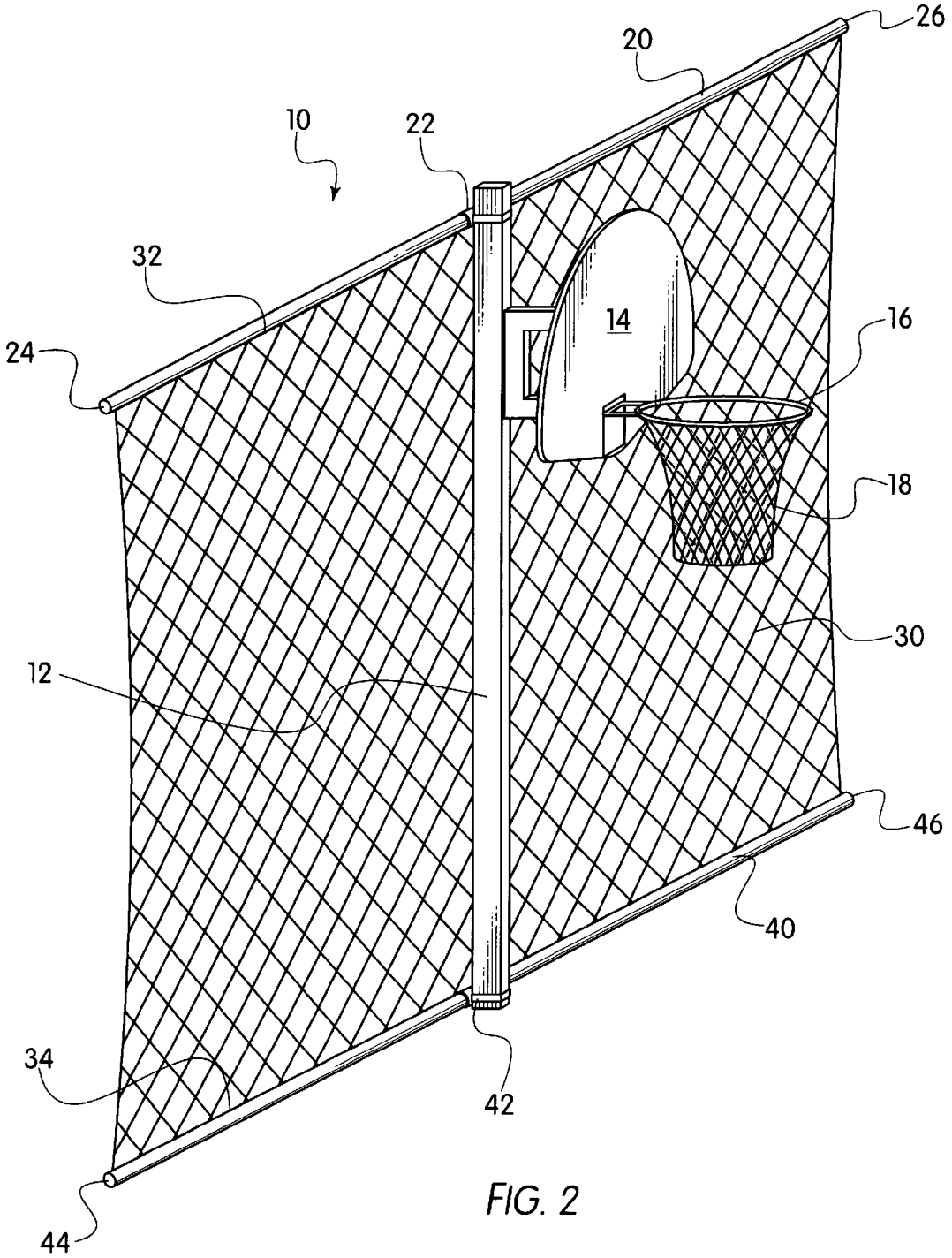
FIG. 2 is a side perspective view of the basketball pole with a basketball retrieval system.

Referring to FIGS. 1 and 2, there is shown a basketball retrieval system 10 connected to a basketball pole 12. Basketball pole 12 also supports backboard 14 and hoop 16. Hanging down from hoop 16 is net 18. Retrieval system 10 comprises a support member 20 extending out behind backboard 14 in a plane parallel to backboard 14. Support member 20 connects to pole 12 with bracket 22. Bracket 22 can be of any known type.

Member 20 has a left end 24 and a right end 26 that extend beyond the width of backboard 14 to form a backstop. Hanging down from support member 20, is a screen 30, that can be made of a net, or a solid cloth. Screen 30 has a top end 32 connected to support member 20, and a bottom end 34 connected to a hanging weight 40. Hanging weight 40 extends the length of support member 20, and can attach to the bottom of basketball pole 12 with bracket 42. In this design, support member 20 and hanging weight 40 keep screen 30 in tension so that when screen 30 fields a basketball, it returns the ball from the screen.

Figure 3:
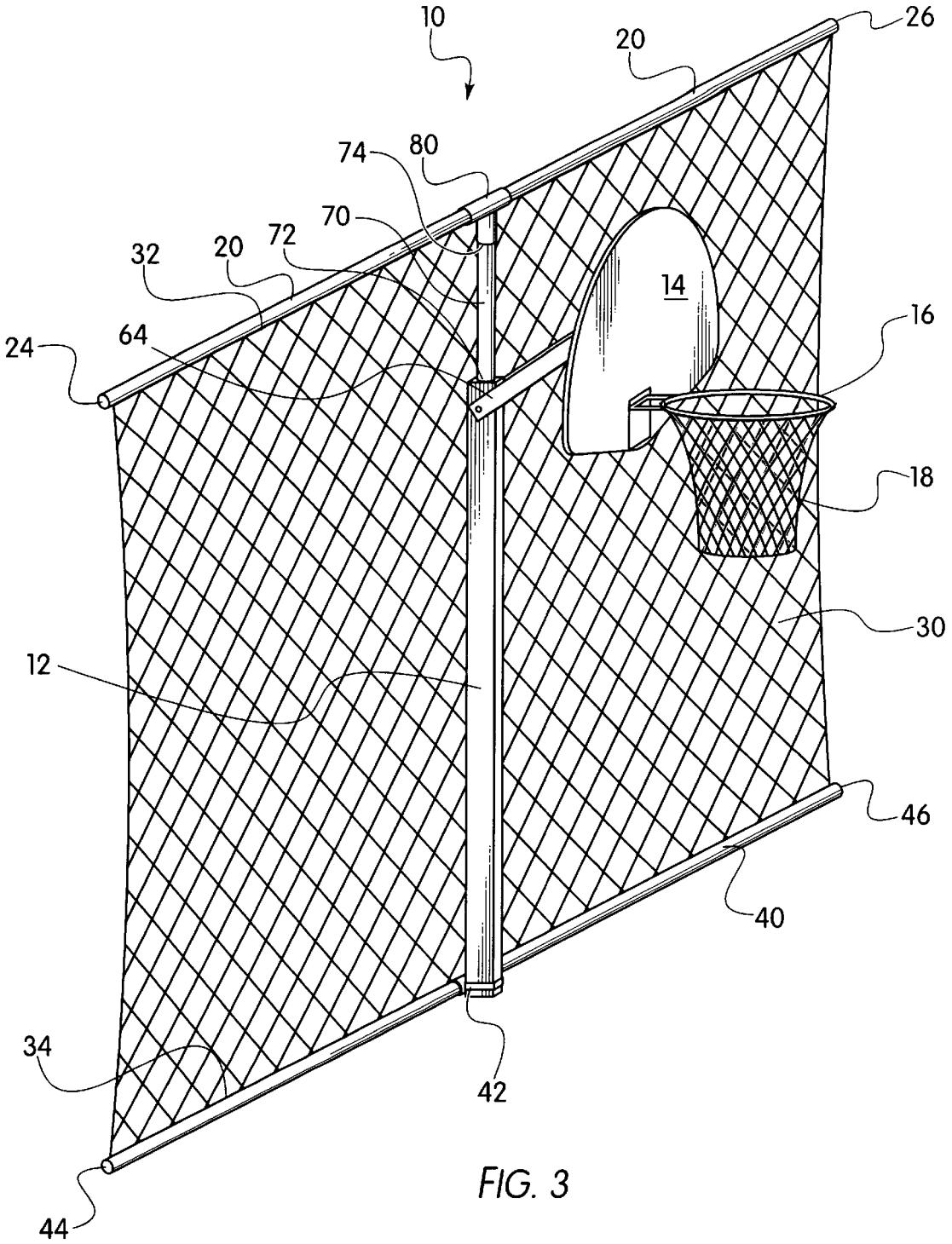
FIG. 3 is a side view of a second embodiment of the basketball retrieval system.

FIG. 3 shows a second embodiment of the basketball retrieval system 10. In this embodiment, there is an elongated vertical pole 70 connected to and extending upwardly from basketball pole 12. Pole 70 extends from pole 12 to a support member 74, and connects via a bracket 80 to support member 20 above basketball pole 12. Bracket 80 is T shaped, and is designed to connect support member 20 to pole 70 at a perpendicular angle. With this extending pole, the support member can be positioned at least thirteen feet above the basketball court.

Poles 20, 40 and 70 may be constructed of thin walled galvanized steel or of aluminum, and have to be of sufficient size and strength to be rigid to hold net 30 in place.

Figure 4A:
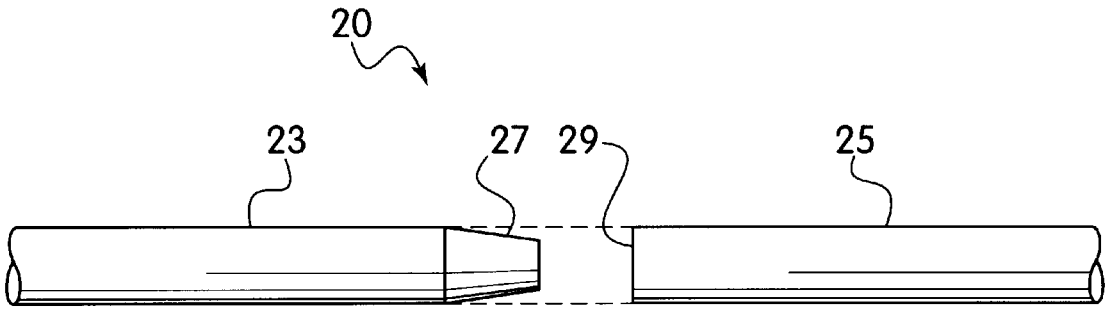
FIG. 4*a* is an exploded view of the support member.
Figure 4B:
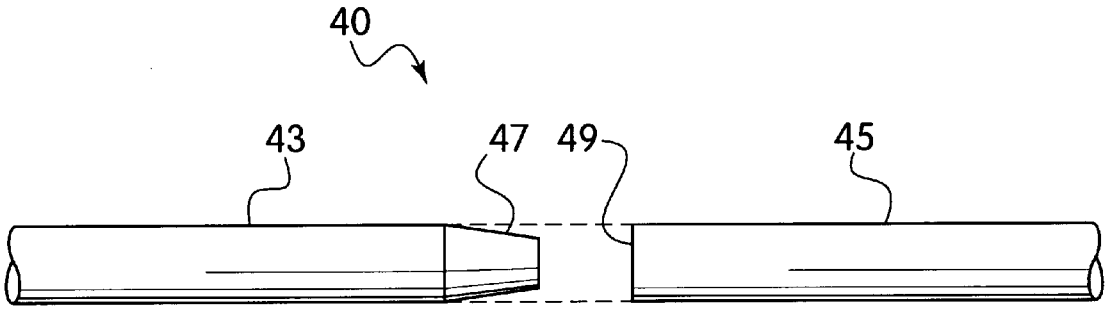
FIG. 4*b* is an exploded view of the hanging weight.

As shown in FIGS. 4*a* and 4*b* both the support member 20 and hanging weight 40 can be in the form of two separate poles 23 and 25, and 43 and 45 respectively. Support member 20 consists of pole 23, which has a tapered end 27 that fits inside open end 29 on pole 25. Hanging weight 40 consists of pole 43, which has a tapered end 47 that fits inside open end 49 on pole 45.

Poles 20 and 40 may be spilt into two sections for the convenience of shipping the backstop systems. In this case, the pole halves would fit into each other to complete a pipe connection inside of T-shaped bracket 80 and bottom bracket 42. Pole 12 may be a pipe or be a hollow, rectangularly shaped rod for receiving and locking vertical pole 70 into place. Net 30 can be constructed of any rope type material such as nylon, polyethylene, etc. and have a grid opening of preferably 1 inch to 4 inches square to allow any wind to pass through. Net 30 is preferably hemmed at its top and bottom so as to capture poles 20 and 40.

While several embodiments of the present invention have been shown and described, it is to be understood that many changes and modifications may be made thereunto without departing from the spirit and scope of the invention as defined in the appended claims.

What is claimed is:

1. A basketball retrieval device for retrieving basketballs back to the playing court that miss a backboard mounted on an elongated vertical pole, comprising:

an upper horizontal support arm coupled to the top of the vertical pole;

a screen having a top end connected to said support arm and extending from the top of said support arm to a basketball court, and a lower horizontal support arm disposed adjacent to the bottom of the basketball pole for capturing a bottom end of said screen and holding said screen in tension, so that said screen forms a basketball backstop for stopping basketballs that fall behind the basketball backboard.

2. The basketball retrieval device as claimed in claim 1, further comprising a support pole that extends substantially vertical from a top end of said basketball pole, said extending pole connecting to said upper support arm.

3. The basketball retrieval device as claimed in claim 1, wherein the screen is a net.

4. The basketball retrieval device as claimed in claim 1, wherein the screen is a solid cloth.

5. The basketball retrieval device as claimed in claim 1, wherein said lower support arm comprises a weight connected to the bottom of said screen, said weight holding said screen in place.

6. The basketball retrieval device as claimed in claim 5, wherein said weight is a bar attached to the bottom end of said screen, said bar extending across the width of said screen.

7. The basketball retrieval device as claimed in claim 1, wherein said bottom end of said screen attaches to the basketball pole.

8. The basketball retrieval device as claimed in claim 1, wherein said upper support arm is a bar extending across the top end of the screen.

9. The basketball retrieval device as claimed in claim 8, wherein said upper support arm is at least nine feet long.

10. The basketball retrieval device as claimed in claim 8, wherein said upper support arm is a galvanized pipe.

11. The basketball retrieval device as claimed in claim 6, wherein said lower support arm is a galvanized pipe.

12. The basketball retrieval device as claimed in claim 2, wherein the vertically extending pole is a galvanized pipe.

13. The basketball retrieval device as claimed in claim 2, wherein said upper support arm is positioned at least 13 feet above the basketball court.

14. The basketball retrieval device as claimed in claim 1, wherein the upper and lower support arms each comprise two-piece pipes that are fitted together.

15. The basketball retrieval device as claimed in claim 3, wherein said net is hemmed at its top and bottom ends to receive and capture said upper and lower support arms.

* * * * *